US009086250B2

(12) United States Patent
Stokes

(10) Patent No.: US 9,086,250 B2
(45) **Date of Patent: *Jul. 21, 2015**

(54) ARCHERY BOW STABILIZER

(71) Applicant: Kyle B. Stokes, Annville, PA (US)

(72) Inventor: Kyle B. Stokes, Annville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/211,781

(22) Filed: Mar. 14, 2014

(65) Prior Publication Data

US 2014/0196708 A1 Jul. 17, 2014

Related U.S. Application Data

(62) Division of application No. 12/954,197, filed on Nov. 24, 2010, now Pat. No. 8,701,645.

(60) Provisional application No. 61/264,091, filed on Nov. 24, 2009.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426; F41B 5/14; F41B 5/066; F16B 13/124
USPC ..... 124/80, 86, 89
See application file for complete search history.

(56) References Cited

U.S. PATENT DOCUMENTS

| | | | | |
|---|---|---|---|---|
| 3,256,872 A | | 6/1966 | Koser | |
| 3,589,350 A | * | 6/1971 | Hoyt et al. | 124/89 |
| 3,623,468 A | * | 11/1971 | Crest | 124/24.1 |
| 3,752,142 A | | 8/1973 | Morita et al. | |
| 4,054,121 A | | 10/1977 | Hoyt, Jr. | |
| 4,553,522 A | | 11/1985 | Topping | |
| 4,556,042 A | * | 12/1985 | Izuta | 124/89 |
| 5,390,654 A | | 2/1995 | Perkins | |
| 5,535,731 A | | 7/1996 | Webster | |

(Continued)

FOREIGN PATENT DOCUMENTS

| | | |
|---|---|---|
| BE | 904490 | 7/1986 |
| DE | 202004004830 | 8/2004 |
| FR | 2695991 | 3/1994 |
| GB | 1296201 | 11/1972 |

OTHER PUBLICATIONS

Doinker Quadra Flex Stabilizer 25 Inch, downloaded from http://shop.eaglearchery.com/browse.cfm/4,4790.html?

(Continued)

*Primary Examiner* — Melba Bumgarner
*Assistant Examiner* — Amir Klayman
(74) *Attorney, Agent, or Firm* — Warner Norcross & Judd LLP

(57) ABSTRACT

An archery bow stabilizer that balances an archery bow and generally inhibits roll, pitch and/or yaw of the bow when the bow is held, drawn, or shot by an archer. The stabilizer can include an optional mounting bracket that mounts to the riser of an archery bow, one or more mounting arms, and one or more stabilizing rods joined with the arms via clamping elements. The rods can be movable forward and rearward relative to the mounting bracket and/or riser to provide a variety of weight adjustment and distribution capabilities. Optional weights can be joined with ends of the rods to provide further weight adjustment and distribution.

15 Claims, 4 Drawing Sheets

(56) References Cited

U.S. PATENT DOCUMENTS

| | | | |
|---|---|---|---|
| 5,630,407 | A | 5/1997 | Gasser |
| 5,649,527 | A | 7/1997 | Olsen et al. |
| 5,904,134 | A | 5/1999 | Denbow |
| 5,992,403 | A | 11/1999 | Slates |
| D448,827 | S | 10/2001 | Chipman |
| 6,499,478 | B1 | 12/2002 | Perez |
| 6,871,643 | B2 | 3/2005 | Cooper et al. |
| 6,957,648 | B1 | 10/2005 | Adcock |
| 2005/0011509 | A1 | 1/2005 | Sandberg |
| 2006/0283435 | A1 | 12/2006 | Pellerite |

OTHER PUBLICATIONS

V-bar, downloaded from http://evansarchery.com/hi%20tek%20online%20store%201.html.

* cited by examiner

ARCHERY BOW STABILIZER

BACKGROUND OF THE INVENTION

The present invention relates to archery bow stabilizers, and more particularly, to archery bow stabilizers that counter movement of the archery bow when the bow is held, drawn and/or shot by an archer.

When an arrow is shot from an archery bow, a variety of translational and rotational movements occur around the location where an archer grips the archery bow, that is, the archery bow grip. These movements can affect the accuracy and the range of the arrow shot from the bow. Generally, the movement about the gripping location are divided into three different movements, namely, pitch, roll and yaw. Pitch occurs when the bow moves up or down from the perspective of an archer drawing or holding the bow. Roll occurs when the bow rotates clockwise or counter-clockwise, while in the archer's hand, from the point of view of the archer drawing the bow. Yaw generally relates to hand torque, where the bow has a tendency to wobble from side-to-side, or left-to-right, about the bow grip from the perspective of an archer drawing or holding the bow.

A variety of archery bow stabilizers are available which attempt to counter pitch, roll and yaw movement. Generally, these stabilizers are weighted and project forwardly from the riser of the bow. Many of these stabilizers are in the form of a cylindrical weighted rod that projects forwardly several inches from the riser. The construction of stabilizers varies, depending on the application. For example, stabilizers used on hunting bows are generally small and compact to enable a bow hunter to adequately maneuver the archery bow in a hunting situation. Stabilizers used for competitive shooting, where there are not space constraints, tend to be rather large.

There are a variety of rather large archery competition stabilizers that include a central rod with additional secondary bars that extend outwardly at an obtuse angle away from the central rod to counter roll, yaw and/or pitch. Some other competition stabilizers include mechanisms to provide adjustment to the structure of the stabilizer, and thus its ability to precisely address roll, pitch and yaw. For example, one type of stabilizer includes a mounting bracket that projects outwardly from opposite sides of the archery bow. Rotatable bars are attached at the ends of the bracket, and rotate to various positions so the mass of the stabilizer bow can be redistributed based on the preferences of the archer.

Most competition stabilizers are designed to include opposing weights or bars on opposite (left and right) sides of the bow to generally balance the bow and prevent it from excessive roll, as well as other movement. In general, the stabilizers attempt to self-balance the archery bow as it is held at the bow grip by the archer.

Another, different type of stabilizer is a counter stabilizer, which includes a single stabilizer bar mounted to a bracket that is mounted to the riser of the bow. The stabilizer bar is generally mounted on the opposite side of a bow from another weighty archery accessory, for example, a bow site or an arrow quiver. The counter-balancing stabilizer includes a mounting bracket that projects only to one side of the bow (opposite the side of the bow on which the counter-balanced archery accessory is mounted), and a weighted stabilizer rod. While these constructions can counter-balance other accessories, it can be less suitable for archery bows where there are no relatively heavy accessories, or where the archer simply desires to better balance their bow and prevent the roll, pitch and yaw movements as described above.

While there are a variety of stabilizers on the market that provide specialized balancing and counter balancing of certain bow accessories, there remains room for improvement for an all-purpose archery bow stabilizer that reduces or eliminates external asymmetric forces which can induce torque or instability in an archery bow.

SUMMARY OF THE INVENTION

An archery bow stabilizer is provided that balances an archery bow to which it is attached to reduce and/or eliminate external asymmetric forces that might otherwise induce roll, pitch and/or yaw of the bow when the archery bow is held, drawn, or shot by an archer.

In one embodiment, the archery bow stabilizer includes a mounting arm element that mounts to the riser of an archery bow and can include one or more stabilizing rods joined with the mounting arm element on opposite sides of the riser. The rods can be moveably, for example, slidably, disposed in relation to the mounting arm element. The rods can be movable forward and rearward relative to the mounting arm element and/or riser to provide a variety of weight adjustment and weight distribution capabilities.

In another embodiment, the mounting bracket can include opposing arms that optionally project symmetrically, outward and away from opposite sides of the bow riser. The arms can terminate at ends which slidingly receive the stabilizing rods. Optionally, the ends can include a clamp that engages the respective rods mounted to the ends of the mounting arm element. The clamp can be selectively tightened and loosened so that the rod can slide relative to the riser to redistribute mass relative to the riser and the bow grip, thereby reducing and/or eliminating external asymmetrical forces and otherwise balancing the archery bow to which the stabilizer is attached.

In yet another embodiment, the mounting arm element can include a first portion, and at least two arms can be in the form of a straight, U-shaped or V-shaped connecting bar. The two arms that form the arm element can include an aperture. Optionally, the mounting arm element can include an aperture. A threaded fastener or other fastener can be positioned through these apertures to join the mounting arm element bar and corresponding arms.

In even another embodiment, the stabilizer can include a mounting bracket within which the mounting arm element and arms consistently register to provide precise alignment between the bracket, these elements and the bow riser.

In still yet another embodiment, the mounting bracket can include a leveling device, such as a bubble level or other leveling element. The bubble level can be joined with the mounting bracket to consistently assist an archer in mounting the mounting bracket, and the stabilizer in general, to the riser of an archery bow in a level manner.

In a further embodiment, the stabilizing rods can be of a generally cylindrical and solid configuration. Each of the rod ends can be configured to include or be joined with a weighted sleeve or other weight. For example, a sleeve can be threaded, glued or otherwise joined with one or more ends of a stabilizer rod. Optionally, the sleeve can be adapted to receive a weighted element that is calibrated to the archer's preference or that otherwise balances the archery bow.

In another, further embodiment, each stabilizing rod can include opposing ends. Each opposing end can include fasteners to join predetermined weights on the ends of the respective stabilizing rods. With the ability to fasten different weights to each of the different ends of the rods, four quadrants of the stabilizer can be specifically balanced to effectively balance the bow and address any roll, pitch and/or yaw movements based on the archer's preference or tendencies in holding, drawing and/or shooting the bow to which the stabilizer is attached.

The archery bow stabilizer herein provides a simple and efficient stabilizing structure to reduce and/or inhibit roll, pitch and/or yaw of an archery bow while being held, drawn or shot by an archer. The archer stabilizer is highly adjustable to provide a variety of weight distributions and stabilizing effects for the archery bow to which it is mounted.

These and other objects, advantages, and features of the invention will be more fully understood and appreciated by reference to the description of the current embodiment and the drawings.

DETAILED DESCRIPTION OF THE CURRENT EMBODIMENT

Figure 1:
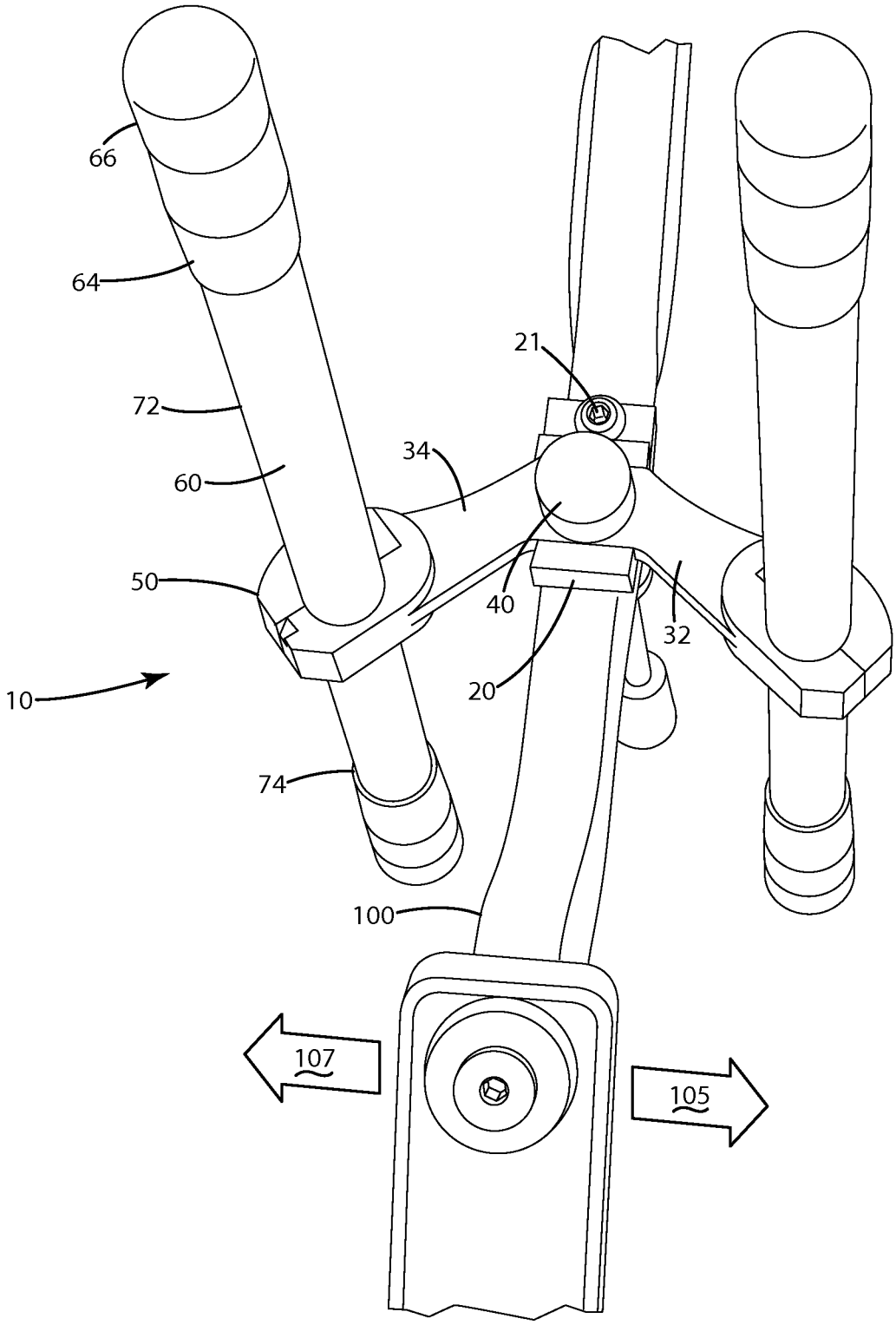
FIG. 1 is a front perspective view of an archery bow stabilizer of a current embodiment mounted to a riser of an archery bow.

An archery bow stabilizer according to a current embodiment is illustrated in FIGS. 1-4 and generally designed 10. The stabilizer generally includes a mounting bracket 20, which mounts directly to the bow, mounting arm element 30 which mount to the bracket, optionally via a fastener 40, and clamping devices 50, which clampingly engage the stabilizing rods or bars 60, and which are adjustable to enable the bars to be slidably moved relative to the clamping devices and/or the stabilizer arms. Optionally, the stabilizer can include weight elements 66 selectively joined with the stabilizing rods 60. The rods and/or weights can be selectively positioned in a variety of spatial orientations to provide balance to the archery bow to which the stabilizer is mounted.

The stabilizer 10 described herein is well suited for single cam compound archery bows, dual cam bows, cam and a half bows, recurves, longbows, crossbows and other archery systems including a bowstring.

Figure 3:
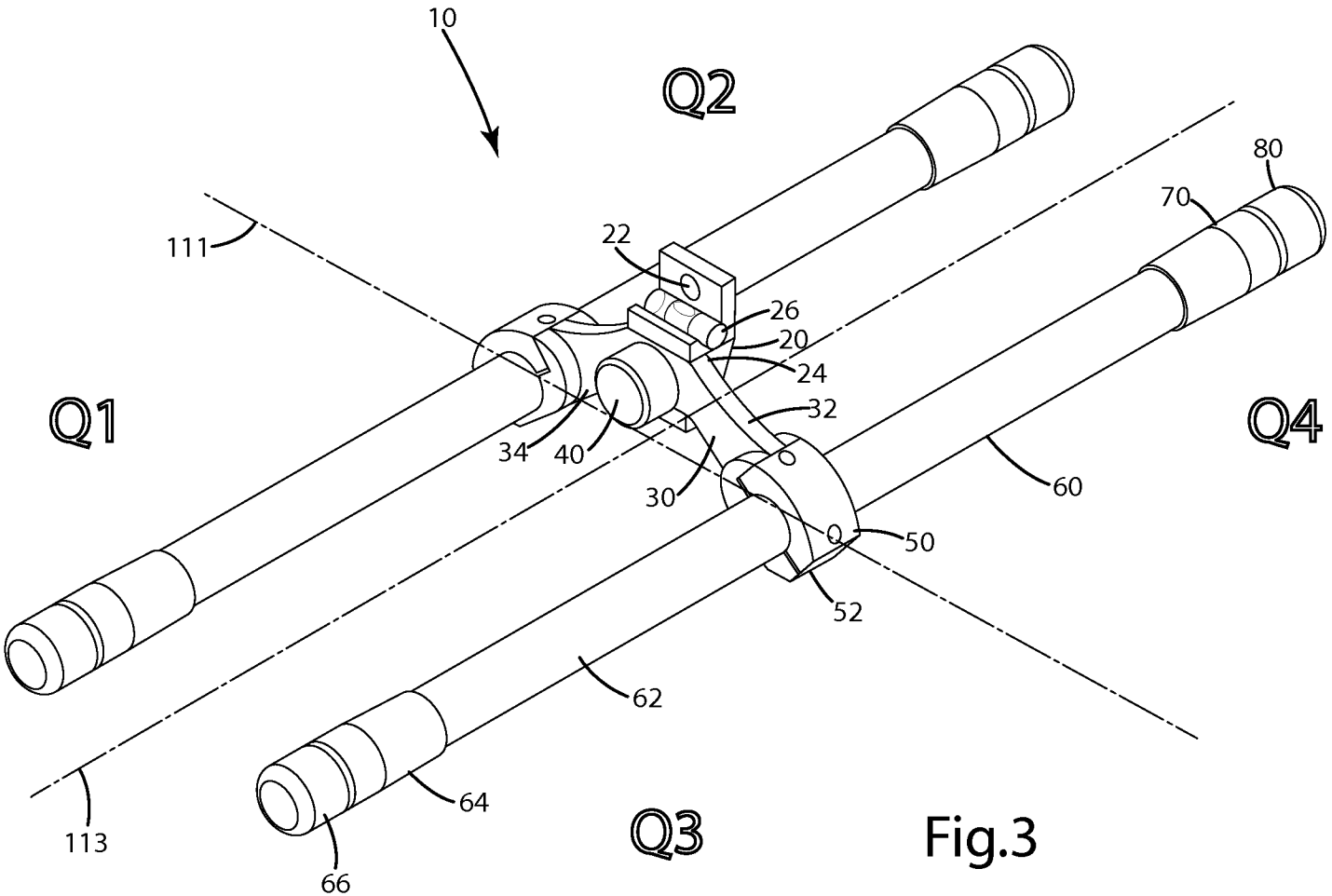
FIG. 3 is another front perspective view of the archery bow stabilizer.
Figure 4:
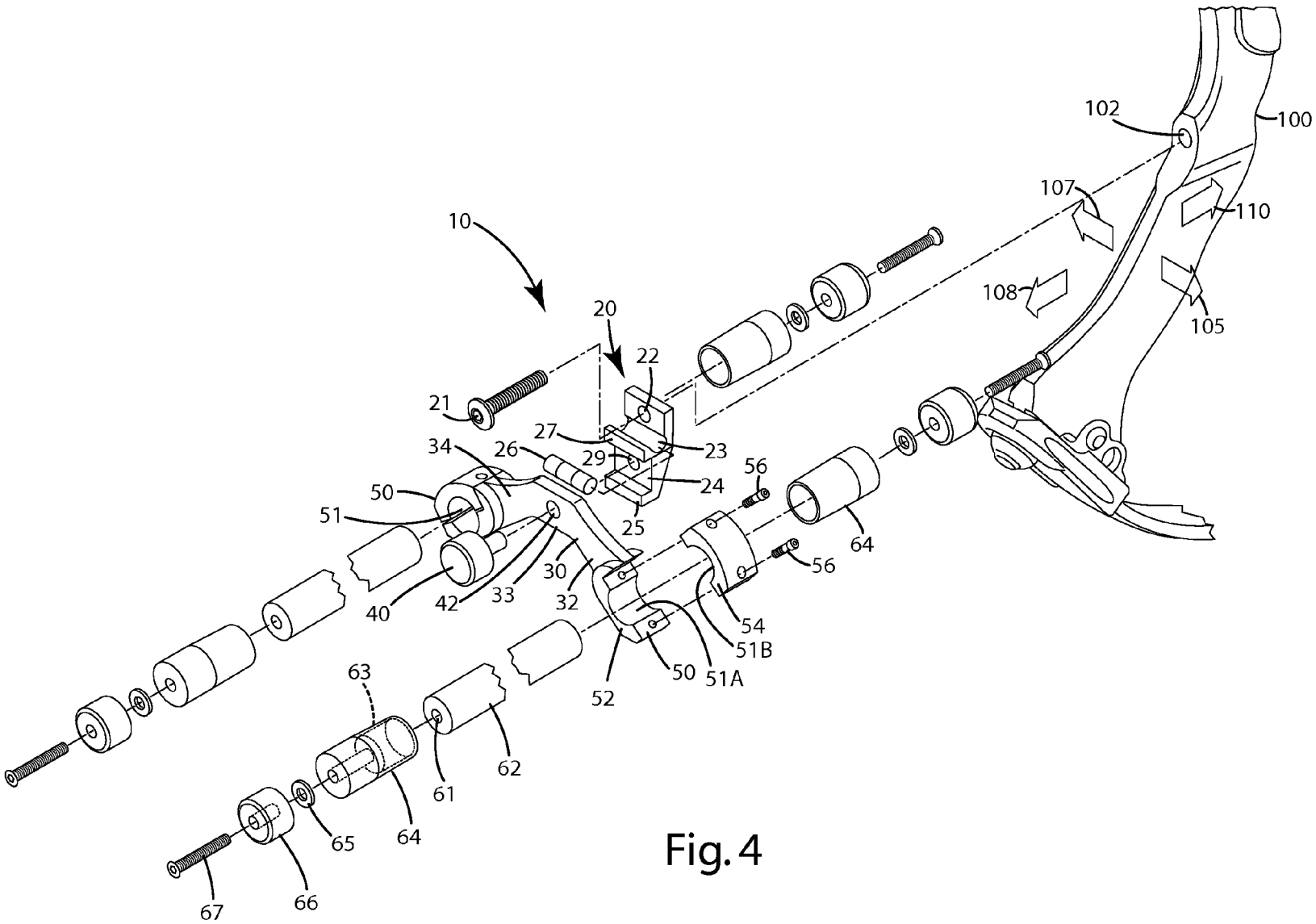
FIG. 4 is an exploded view of the archery bow stabilizer.

The construction of the stabilizer will now be described in more detail. Referring to FIGS. 3 and 4, the mounting bracket 20 can be mounted to the riser 100 of the bow via a fastener 21 that fits through an aperture 22 defined by the mounting bracket 20. The aperture can be of any pre-selected configuration, but as shown, is generally circular to accommodate a round threaded fastener including a head 21. The head of the fastener can be threaded through or loosely received through the aperture 22 and subsequently threaded into the riser stud aperture 102 defined by the riser 100. Generally, the fastener 21 can be tightened sufficiently so that there is no movement of the stabilizer mounting bracket 20 relative to the riser 100.

If desired, the mounting bracket 20 can mount to the riser via another mechanism. For example, a stud can project from the riser stud hole 102 and a nut can be threaded over the end of the stud to hold the mounting bracket adjacent the riser. As another example, the bracket can include a quick-disconnect attachment element, which can mount the bracket to the riser.

The mounting bracket 20 can define a level receiving portion 23, which is generally shown as a partially cylindrical first recess. The first recess 23 can be a variety of other configurations to accept a leveling device, such as the illustrated bubble level 26. The bubble level 26 can be a conventional bubble level, and can be precisely joined with the mounting bracket 20 to indicate when the mounting bracket, and thus the mounting arm element 30 and respective rods 60, are level relative to the bow riser 100, or in some other predetermined spatial relationship relative to the riser.

Optionally, the rearward face of the mounting bracket 20 or other surfaces thereof can include indexing marks that align with certain features of the archery bow 100 to provide alignment consistency when an archer mounts and detaches the bracket repeatedly relative to the riser.

The mounting bracket can defines a recess of slot 24 located below the mounting fastener, or generally, the location where the bracket is directly connected to the riser of the archery bow. This recess can be sized and oriented to receive and hold a mounting arm element 30. More specifically, the central portion 33 of the mounting arm element 30 can be registered within and securely held in the recess. The slot 24 and central portion 33 of the mounting arm element 30 can be precisely machined and/or formed so that they register consistently and precisely relative to one another and so that there optionally is restricted or no movement between these elements. The central portion 33 of the mounting arm element 30 can define an aperture 42 through which a fastener 40 fits. The fastener 40 can further be threaded into the mounting bracket 20, and in particular, an aperture 29 defined by the mounting bracket. This mounting bracket aperture 29 can be threaded to correspond to the threads of the fastener 40. The fastener 40 can include a knurled or otherwise manually grippable surface so that the fastener 40 can be easily manually removed, without the use of tools, so that the mounting arm element can be removed from the mounting bracket.

The above construction can facilitate transportation, disassembly and take down of the stabilizer relative to the archery bow and subsequent transportation of the stabilizer and bow. Of course, other fastening fasteners can be substituted for the third fastener 40. For example, that fastener can be replaced with a cammed or quick detach fastener mechanism, or some type of fastener that requires use of tools, such as a bolt or threaded stud. Moreover, if desired, the mounting arm element 30 itself can be mounted directly to the riser, with the mounting bracket 20 being absent if desired. The mounting arm element 30 in such a case can include an aperture, with a fastener fitted through the aperture joining the element and the riser (not shown). If desired, the mounting arm element can include guides or flanges to assist in registering the element with the riser (not shown). Further, the element can include a leveling device like that described above.

Turning to FIGS. 3 and 4, the arms 32 and 34 and central portion 33 of the mounting arm element generally form a U- or V-shaped structure, with the bottom of the V, pointed upward and the arms 32 and 34 projecting outwardly toward the sides 105 and 107 of the riser 100. The arms 32 and 34 can be of any desired length and of any geometric configuration. For example, if desired, the arms 32 and 34 could extend outwardly generally along a straight line from the central portion 33. Further, the thickness of the arms can vary as desired, and can generally be thicker or shorter, depending on the desired weight distribution of the stabilizer. The arms 32 and 34 can be of any cross section, that is, they can be square, rectangular, octagonal, ellipsoid, circular, and like. The arms 32 and 34 and generally the mounting arm element 30 can be contoured in any configuration, depending on the application. Although shown as a single integral piece, the arms 32 and 34, and the central portion 33 can be constructed from different pieces of material that are joined together with fasteners or otherwise connected to one another. Moreover, although shown as including two arms extending symmetrically from the central portion, the stabilizer can be asymmetric, with only one arm extending from one side of the central portion in certain applications.

As shown in FIGS. 3 and 4, the ends of the arms 32 and 34 terminate at the clamps 50. These clamps 50 can include a two-piece construction where the first piece of the construction 52 is formed by the end of the arm and the second piece is a free and independent, separately formed bracket clamp member 54 that joins with the first member 52 of the clamp. The joining can be accomplished via a variety of fasteners, clamping mechanisms and the like. For example, as illustrated in FIG. 4, the second clamp member 54 can be joined with the first clamp member 52 via fasteners 56 that project through a portion of the first clamp member 54 and that thread into the second clamp member 52. These fasteners 56 can be conventional screws, bolts, rivets and the like, and can be tightened to a desired tightness to bring the first clamp number and the second clamp number together to clampingly engage in the respective stabilizing rods 60, holding those rods 60 in place.

Optionally, one or both of the clamps can include a recess 51 that is adapted to at least partially receive the respective stabilizing rod. As shown in FIG. 4, the recess can include first 51A and second 51B portions defined by the mounting arms 32, 34 and bracket clamp members 54, respectively. The precise portions of the recess formed by the respective components can vary as desired. Moreover, in come cases, only one of the components may define the recess, with the other component simply forming a closure of the recess.

Optionally, the illustrated clamps 50 can be replaced with an alternative construction, for example, a set screw-type clamp where a threaded element is threaded through the end of the arms 32 and 34 to engage the surface of the respective stabilizing bars 60. In such construction, the ends of the arms could simply define an aperture sufficient to accommodate the respective stabilizing bars. Further optionally, the clamping elements can be in the form of a tube and hose connector that includes a rotatable portion that is manually rotatable, and which includes internal fingers that flex toward and engage the respective rods 60 as the rotatable portion is rotated. Even further optionally, the clamping elements can be in the form of collet fittings that engages and hold the respective stabilizing bars. A variety of other clamping devices can be utilized as desired.

The arms, clamps and fasteners, as well as the other components of the stabilizer, can be constructed of any material, such as aluminum, aluminum alloys, magnesium, metals, plastics, synthetic materials and composites and the like, and can be CNC machined, molded, cast, or otherwise formed using conventional construction processes.

Turning now to the stabilizer rods 60, these elements, generally include a main body portion 62 and end sleeve 64. To the end sleeve 64, weight elements or weights 66 can be joined using a fastener 67 or another connection mechanism. As shown, the fastener 67 can be threaded directly into the ends of the rods 62, specifically the apertures 61, to hold the sleeve and the weights (if included) on the ends of the rods. The apertures 61 in the rods can be threaded or can include metal threaded inserts that are molded into the material from which the rod 62 is constructed.

Each end of the respective left and right rods can include their own separate weights and sleeves, if desired. Optionally, the weights 66, can come in a variety of different increments, for example, 4, 6, 8 and 10 ounce weights can be provided with the archery stabilizer. Depending on the user's preference, different weights can be positioned in each of the four quadrants at each of the ends of the rods. Further optionally, in some cases, the sleeves themselves can be the weight elements.

The quadrants Q1, Q2, Q3, and Q4 shown in FIG. 3 are defined by lines 111 and 113 which generally run through the longitudinal and lateral axes of the arms 30 and/or mounting bracket 20. With different weights, or the same weights selectively moved by sliding the rods relative to the clamping elements and positioning them in preselected locations in the quadrants, an archer can distribute the mass of the archery stabilizer elements in a variety of combinations in the four quadrants Q1, Q2, Q3, and Q4 to provide a desired counter effect against roll, pitch and yaw of the archery bow when it is held, drawn and/or shot by the archer. The archer can also establish a center of gravity of the stabilizer and locate that center of gravity in a preselected location, for example, near the mounting bracket and its point of attachment to the riser. With such a construction, the bow can be balanced so as to reduce or eliminate external asymmetric forces that could otherwise induce torque or instability.

In the embodiment shown, one stabilizing rod can include first and second ends, and the other stabilizing rod can include third and a fourth ends. The respective ends can be located in respective ones of the ends can be located in the respective Q1, Q2, Q3 and Q4 quadrants. When respective weight elements 66 are selectively positioned in each of the first, second, third and fourth quadrants, this can provide balance to the archery bow against roll, pitch and/or yaw.

The stabilizing rods 60 can be disposed on opposite (left and right) sides of the riser, and can extend in parallel to one another on those opposite sides. The rods also can be generally aligned with one another. Optionally, the stabilizing rods on opposite sides can be slightly tapered towards one another to form a generally V-shape when viewed from the top of the riser down. When in this configuration, the rods are deemed to be at an offset angle relative to one another. The amount of the angle can vary with the respective application and can be selected depending on the intended use of the stabilizer 10.

The rods 62 of the archery bow stabilizer can be constructed from a variety of materials. As illustrated, the rods are constructed from a translucent and/or transparent acrylic material. Of course, this acrylic material can be substituted with any type of polymer, composite material, metal or combination of these materials as desired. The rods 62 can be cylindrical as shown, however, they alternatively can be of any geometric configuration. For example, the cross section may be varied so that the rods are of a square, ellipsoid, rectangular, triangular, trapezoidal, and/or polygonal cross section. Moreover, the cross section can vary along the length of the rods. Indeed, the overall cross section can vary in size along the length of the rod, although not shown.

Optionally, the rods can include indicia, such as lines, so that a user can establish a reference corresponding to a specific configuration of the rod relative to the clamping element. Accordingly, the user can return the rod to that configuration later if desired, or can use the reference to compare the balance of the bow in different configurations of the rod and select a preferred one.

Referring to FIG. 4, the sleeves 64 located at the ends of the rods can be tapered from an inner portion to an outer portion. In addition, the sleeve 64 can define an internal bore 63 which is generally sized and shaped to correspond to the end of the rod 62. Accordingly, the sleeve 64 can fit over the end of the rod with the end of the rod inserted into the bore 63. Optionally, a washer constructed from a polymeric metal or rubber material 65 can be interposed between the end of the sleeve and an added weight 66. Again, the weight 66 can come in a variety of shapes, sizes and weights. Of course, if desired, the sleeve 64 can be absent from the design all together. In such a construction, the ends of the rods can simply include a washer and/or aperture adapted to receive a fastener to secure a weight 66 to the end of the rods 62. Further optionally, the ends of the rods can simply be capped or open, with no additional external weights or items joined with those ends. In such an embodiment, movement of the rods relative to the mounting arm element 30 can provide a redistribution of weight to balance the archery bow.

Figure 2:
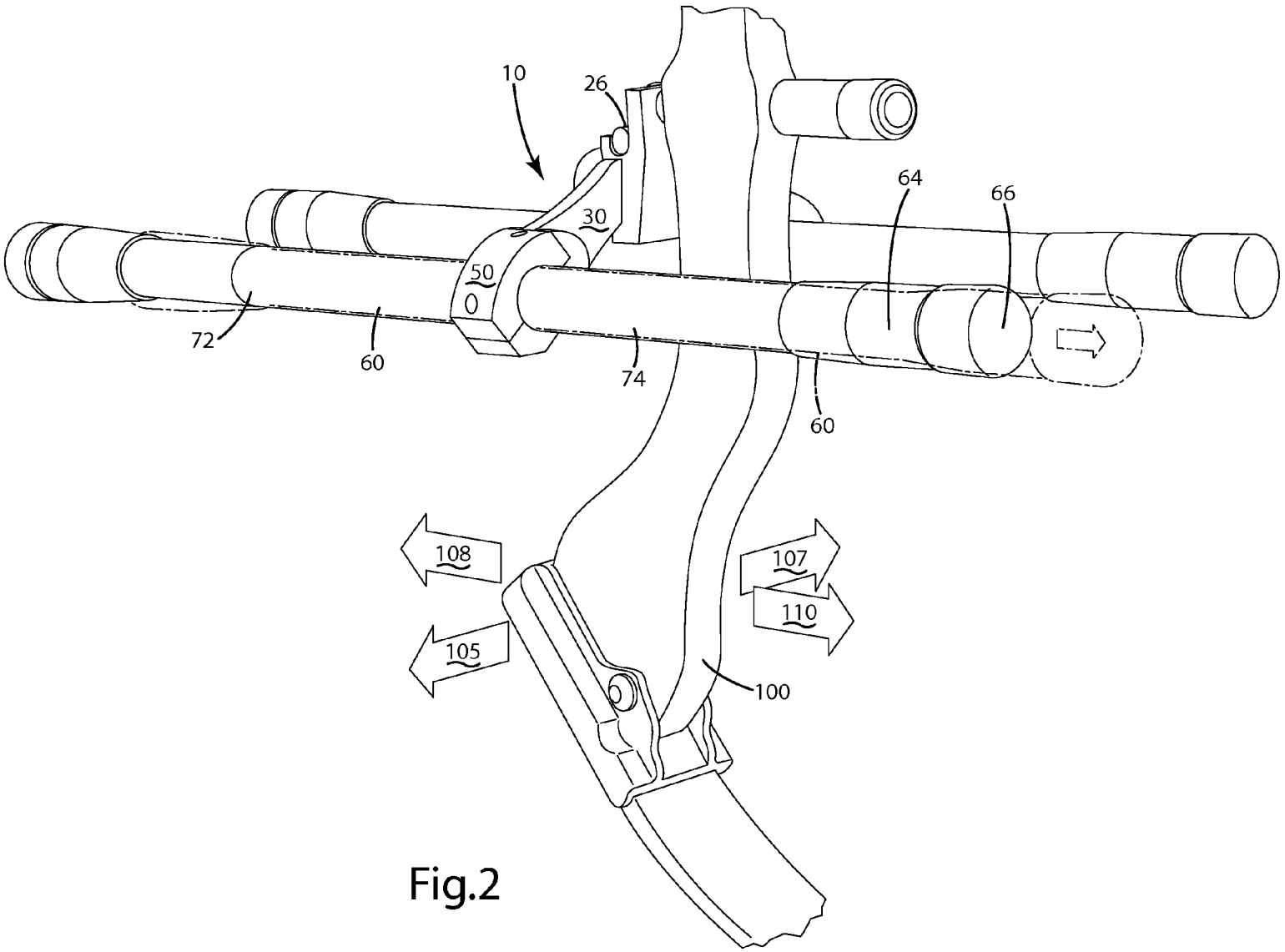
FIG. 2 is a rear perspective view of the archery bow stabilizer mounted to the archery bow.

As shown in FIGS. 1 and 2, when the stabilizer 10 is mounted to the forward portion of the bow riser 100, the mounting bracket 20 projects forwardly from the front of the riser 100 and is secured to it with the mounting fastener 21. The arms 34 and 32 project outwardly to the sides 105 and 107 of the bow. In general, the mounting arms project on both opposite sides 105 and 107 of the bow riser 100. The stabilizer rods 60 are mounted to the ends of the arms via the clamps 50, which can be any of the clamps described above. These rods 60 can be slidably received in those clamps and slid forward or rearward, depending on the particular weight distribution desired in each of the quadrants, Q1, Q2, Q3, Q4 (FIG. 3) of the bow stabilizer to provide a desired location of a center of gravity. As also shown in FIG. 2, the stabilizer rods can be of a length sufficient that the rods 60 project both forward of the riser, that is, in front of the riser 108, as well as to the rear 110 of the riser.

In general, a first portion 72 of each rod projects forward of the arms 32, 34 and optionally forward of in the front 108 of the riser 100. A second portion 74 of the rod 60 is contiguous and aligned with the first portion 72 along a straight line. The second portion 74 projects rearwardly from the arms 30, and if desired, projects past the riser 100 rearward of the rear 110 of the riser. As shown in FIGS. 1 and 2, the weight of the rods on opposite sides of the riser, or to the front and rear of the riser, can cancel one another out and inhibit roll, pitch and/or yaw as the archery bow is held, drawn and/or shot. In turn, this can provide a benefit to the archer knowing that their bow is well balanced.

In operation, the stabilizer 10 can be mounted to the riser via the mounting bracket 20 and the fastener 21. The mounting bracket can be leveled relative to the riser using the leveling device 26. The mounting arm element 30, with the rods attached thereto, can be registered with the bracket 20 and installed on the mounting bracket with the fastener 40.

With the stabilizer 10 installed on the riser, the stabilizer can be configured to provide a desired balance to the bow. For example, the clamping elements 50 can be loosened so that the rods can be slid forward or rearward as desired relative to the mounting arm, thereby redistributing the weight of those rods among each of the four quadrants Q1, Q2, Q3 and Q4. The rods can be moved so that the center of gravity of the stabilizer is in a spatial orientation relative to the riser that is suitable to the archer to reduce or eliminate roll, pitch or yaw when the bow id held, drawn or shot. When a desired spatial orientation is achieved, the clamping elements can be tightened, thereby fixedly holding the rods in place relative to the mounting arm element.

Where the rods are configured to have weights added to them, those weights can be added in a desired distribution among the four quadrants to achieve a desired balance to the bow. In some cases, the weights can be added, and the rods can be moved as described above. In other cases, similar or different weights can be added in a preselected combination to balance the bow.

The above descriptions are those of current embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery bow stabilizer adapted to mount to a riser of an archery bow, the stabilizer comprising:

a mounting arm element including a portion adapted to be located proximal an archery bow riser and a first mounting arm adapted to extend outwardly on a first side of the archery bow riser;

a first clamping element, joined with a first end of the first mounting arm, the first clamping element operable in a clamped mode and an unclamped mode, the first clamping element adapted to be positioned on the first side of the archery bow riser;

a first stabilizing rod slidably received by the first clamping element when the first clamping element is in the unclamped mode so that the first stabilizing rod can be slid at least one of forward and backward to redistribute a weight of the first stabilizing rod in at least one of two lateral quadrants being a first quadrant located forward of the riser and a second quadrant located rearward of the riser the first stabilizing rod fixedly held by the first clamping element when the first clamping element is in the clamped mode, the first stabilizing rod extending forwardly and rearwardly of the riser, the first stabilizing rod including a first end and a second end, the first end adapted to be located forward of the riser in the first quadrant of the stabilizer, the second end adapted to be located rearward of the riser in the second quadrant of the stabilizer when the stabilizer is mounted to the riser; and a first weight element joined with the first end of the first stabilizing rod and a second weight element joined with the second end of the first stabilizing rod, the first weight element selectively positioned in the first quadrant, the second weight element selectively positioned in the second quadrant, whereby the first stabilizing rod balances the archery bow and reduces or eliminates at least one of roll, pitch and yaw of the archery bow, wherein the first clamping element includes a first arm end, wherein the first clamping element includes a first bracket clamp member, wherein at least one of the first arm end and the first bracket clamp member define a rod recess, wherein the first bracket clamp member defines a first hole on a first side of the first stabilizing rod and a second hole on an opposite side of the first stabilizing rod, the opposite side distal from the first side, so that the first stabilizing rod is located between the first hole and the second hole, wherein the first bracket clamp member is free and removable from the first arm end.

2. The archery bow stabilizer of claim 1 comprising a mounting bracket defining an aperture through which a fastener is positioned, the fastener adapted to join with the archery bow riser.

3. The archery bow stabilizer of claim 1 comprising a mounting bracket adapted to join with the archery bow riser, the mounting bracket defining a slot, wherein the mounting arm is registered with the slot of the mounting bracket and joined with the mounting bracket via a fastener.

4. The archery stabilizer of claim 3 wherein the first arm end defines a third hole aligned with the first hole and a fourth hole aligned with the second hole, wherein the third hole is defined on the first side of the first stabilizing rod, wherein the second hole is defined on the opposite side of the first stabilizing rod, the opposite side distal from the first side, so that the first stabilizing rod is located between the third hole and the fourth hole.

5. The archery stabilizer of claim 1, wherein the first arm end defines a first recess portion, wherein the first bracket clamp member defines a second recess portion, wherein the first bracket clamp member is secured to the first arm end with a first fastener and a second fastener, wherein the first recess portion and second recess portion cooperatively engage and surround at least a portion of the first stabilizing rod in the clamped mode, wherein the stabilizing rod is located between the first fastener and the second fastener.

6. The archery bow stabilizer of claim 1 wherein the first arm end defines threaded holes aligned with the first and second holes defined by the first bracket clamp member.

7. The archery bow stabilizer of claim 6 wherein first and second fasteners are threaded into the threaded holes.

8. The archery bow stabilizer of claim 1 wherein the first stabilizer rod projects and extends through the first clamping element.

9. The archery bow stabilizer of claim 1, wherein the mounting arm element defines a connector aperture sized to secure a fastener positioned at least partially through the aperture to secure the stabilizer to archery bow.

10. The archery stabilizer of claim 1 comprising an elongate threaded fastener that joins the first weight element with the first end of the first stabilizing rod.

11. The archery stabilizer of claim 10 wherein the first end defines a threaded hole, wherein the elongate threaded fastener is threaded into the threaded hole.

12. The archery bow stabilizer of claim 1 wherein the first arm end substantially defines the rod recess with the first bracket clamp member forming a closure of the rod recess.

13. The archery bow stabilizer of claim 1 wherein the first bracket clamp member is independent and separately constructed from the first mounting arm and connected to the first mounting arm only by a first fastener and a second fastener.

14. The archery bow stabilizer of claim 1 comprising a first fastener in the first hole and a second fastener in the second hole, wherein the first stabilizing rod is between the first fastener and the second fastener.

15. The archery bow stabilizer of claim 1 comprising a first fastener and a second fastener, the first fastener disposed at least partially through the first hole, the second fastener disposed at least partially through the second hole, the first fastener being separated from one another by the stabilizing rod therebetween.

* * * * *